US005921808A

United States Patent [19]

Haftmann et al.

[11] Patent Number: 5,921,808

[45] Date of Patent: Jul. 13, 1999

[54] RIBBON CABLE PLUG-IN CONNECTOR

[76] Inventors: Johannes Haftmann, Schaftnacherwerg 31, D-91126 Rednitzhembach; Andrea Wagner, Mindelheimer Str. 72, D-90455 Nuremberg; Anders Karlstrom, D-91341Erlenstrasse 1A, Rottenbach; Ewald Bell, Stuttgarter Str. 22, D-91710 Gunzenhausen; Seref Ozdal, Augsburger Str.10, D-91781 Weissenburg; Harald Steinmetz, Bahnberg 16, D-91785 Pleinfeld-Ramsberg; Josef Muhling, Birkenring 14, D-91785 Pleinfeld-Mischelbach, all of Germany

[21] Appl. No.: 08/982,916

[22] Filed: Dec. 2, 1997

Related U.S. Application Data

[63] Continuation of application No. 08/607,517, Feb. 27, 1996.

[30] Foreign Application Priority Data

Apr. 5, 1995 [DE] Germany ..... 195 12 788

[51] Int. Cl.[6] ..... H01R 23/66

[52] U.S. Cl. ..... 439/495; 439/358

[58] Field of Search ..... 439/493, 67, 65, 439/631

[56] References Cited

U.S. PATENT DOCUMENTS

| | | | |
|---|---|---|---|
| 4,172,626 | 10/1979 | Olsson | 339/17 |
| 4,385,795 | 5/1983 | Endoh et al. | 339/176 |
| 4,695,108 | 9/1987 | Ichitsubo | 439/59 |
| 4,969,828 | 11/1990 | Bright et al. | 439/68 |
| 5,186,632 | 2/1993 | Horton et al. | 439/67 |
| 5,389,741 | 2/1995 | Ueno | 174/117 |

FOREIGN PATENT DOCUMENTS

| | | |
|---|---|---|
| 0 476 355 | 3/1992 | European Pat. Off. . |
| 0 631 351 | 12/1994 | European Pat. Off. . |
| 3050610 | 6/1985 | Germany . |
| 54-157001 | 12/1979 | Japan . |
| 60-147188 | 9/1985 | Japan . |
| 6-119956 | 7/1994 | Japan . |
| 6-96816 | 7/1994 | Japan . |

*Primary Examiner*—Neil Abrams
*Assistant Examiner*—Eugene G. Byrd
*Attorney, Agent, or Firm*—Gary A. Samuels

[57] ABSTRACT

A ribbon cable plug-in connector is provided for plug-in connection of a strip-type electrical ribbon cable. One end of the ribbon cable is provided with a locking rib that cooperates with a locking arm and locking shoulder of a plug-in connector housing when the ribbon cable is inserted into an opening of the plug-in connector housing.

23 Claims, 6 Drawing Sheets

RIBBON CABLE PLUG-IN CONNECTOR

CROSS-REFERENCE TO RELATED APPLICATION

This application is a continuation of application Ser. No. 08/607,517, filed Feb. 27, 1996 (allowed).

FIELD OF THE INVENTION

The present invention relates to a plug-in connector for connecting a ribbon cable to strip conductors of a printed circuit board.

BACKGROUND OF THE INVENTION

Ribbon cables for use with printed circuit boards typically have a series of electrical conductors embedded next to each other in an insulation material. The conductors can be round conductors with a circular cross section and/or flat conductors with a rectangular cross section. A plug-in connector housing for receiving such a ribbon cable has a cable plug-in opening to accept a ribbon cable end, and conductor contact receptacles to accept conductor contacts extending into the cable plug-in opening. The conductor contacts are electrically connected to terminal contacts that can be connected, for example, to the strip conductors of a printed circuit board by soldering.

In order to permit electrical contacting between the ribbon cable conductors and the conductor contacts of the plug-in connector, the ribbon cable conductors are exposed on one ribbon cable end, on a broad side of the ribbon cable, by stripping the insulation therefrom. The conductor contacts have contact regions with contact springs that engage the exposed ribbon cable conductors when the ribbon cable end is plugged into the cable plug-in opening of the plug-in connector. However, the ribbon cable end loses its bending rigidity upon the stripping of the insulation. This may hamper the inserting of the ribbon cable end into the cable plug-in opening of the plug-in connector, and may complicate electrical contact between the exposed ribbon cable conductors and the contact springs of the conductor contacts. To overcome these shortcomings, a reinforcement layer, preferably in the form of a reinforcement sheet, is applied on the broad side of the ribbon cable end on which the ribbon cable conductors are not exposed. This increases the bending rigidity of the ribbon cable end reduced by the stripping of the insulation. A material with relatively high intrinsic bending rigidity is typically used for such a reinforcement sheet.

Although this type of reinforced connector may operate with varying degrees of success in use, this type of reinforced connector is replete with shortcomings which detract from its widespread usefulness. More particularly, this type of ribbon cable has a sheet structure with a thickness of about 0.4 mm. Conventional plug-in connectors used for connection of ribbon cables have a limited design height of about 10 mm. Accordingly, from the beginning of the cable plug-in opening, to the spring contacts of the conductor contact, a lateral guide for the thin ribbon cable only exists over a short zone of about 7 mm. Also, conventional plug-in connectors for connection of such ribbon cables have significant manufacturing tolerances. Therefore, a ribbon cable end must be plugged into the cable plug-in opening of the plug-in connector with only limited guide depth and unreliable lateral guiding. The probability that such a reinforced ribbon cable end will be plugged in obliquely or even with kinks in the plug-in connector is extremely high. Because of the narrow spacing pattern of the ribbon cable conductors and the conductor contacts in the plug-in connector, inaccurate insertion can easily lead to an alignment situation in which the ribbon cable conductors are not properly brought in contact with the corresponding conductor contacts.

In addition to the foregoing, the force with which the contact spring arms of the conductor contacts engage the ribbon cable conductors is limited given the very limited size of the conductor contacts. Therefore, the ribbon cable conductors may loosen from the conductor contacts, even if a small tensile force is exerted on the ribbon cable.

There is a need for an improved plug-in connector for establishing a high reliability connection with a ribbon cable end.

SUMMARY OF THE INVENTION

The ribbon cable plug-in connector of the present invention has a locking projection or protrusion on the ribbon cable end and a locking arm provided with a complimentary locking shoulder on the plug-in connector housing. The locking protrusion and the locking shoulder of the locking arm cooperate when the ribbon cable end has been inserted far enough into a cable plug-in opening of the connector housing. The ribbon cable end is secured in this fashion against withdrawal from the cable plug-in opening.

The design height of the plug-in connector housing and the insertion depth of the cable plug-in opening are preferably chosen large enough so that the ribbon cable end is guided into the cable plug-in opening over a relatively large length before contact occurs between a ribbon cable conductor and a conductor contact. Lateral pivoting of the ribbon cable end, which can lead to incorrect contacting between the ribbon cable conductors and the conductor contacts, is thereby prevented.

The plug-in opening is preferably provided with a locking protrusion guide, which can be a guide recess in which the locking protrusion arranged on the ribbon cable end is guided during insertion of the ribbon cable end into the cable plug-in opening of the plug-in connector housing.

If at least one transverse end of the locking protrusion is provided with an end surface that cooperates in sliding fashion with a limiting wall of the guide recess, guiding can be assumed by the guide protrusion at least for the long side of the ribbon cable end. Both transverse ends of the locking protrusion could also be provided with an end surface that cooperates with a limiting wall on each guide recess. In this case both sides of the ribbon cable end are guided by the guide protrusion.

In a particularly preferred embodiment of the present invention, the locking protrusion has a smaller width than the ribbon cable, and is arranged asymmetrically displaced relatively to the center of the cable length. For example, one end surface is aligned on one transverse end of the locking protrusion with a longitudinal side edge of the ribbon cable, whereas an end surface of the locking protrusion opposite this is positioned opposite the other longitudinal side edge of the ribbon cable end. In this case, the guide recess is arranged asymmetrically displaced accordingly relative to the longitudinal center line of the ribbon cable. In this fashion, a coding is achieved, i.e., prevention against insertion of the ribbon cable into the cable plug-in opening in the incorrect position, as well as prevention of insertion of a ribbon cable end into a plug-in connector that is not suitable for connection with this special plug-in connector is achieved.

The locking protrusion preferably has the shape of a locking rib, which again preferably has a square or rectangular shape.

The plug-in connector housing itself can be provided with the locking arm, and optionally, the locking protrusion guide or guide recess and the plug-in connector housing can be designed with such a height that a depth of the cable insertion opening is achieved that leads to sufficiently secure lateral guiding of the ribbon cable end.

If for any reason use of a conventional plug-in connector is desired, which has not only large manufacturing tolerances, but also limited design height and thus limited insertion depth for the ribbon cable end with correspondingly reduced protection against oblique insertion or pivoting of the ribbon cable, a locking spring housing of an alternate embodiment of the present invention can be used as an additional housing. This additional housing has a cable plug-through opening for the ribbon cable end, and a plug-in opening to insert the usual plug-in connector housing into a position so that the ribbon cable end can reach the cable insertion opening of the plug-in connector opening through the cable plug-through opening of the additional housing. The additional housing is provided with a locking arm and optionally, a locking device guide or a guide recess. The desired insertion depth for the ribbon cable that permits sufficient safety against pivoting or oblique insertion of the ribbon cable end into the plug-in opening of the plug-in connection can be created by the design height of this additional housing. The plug-in opening of the additional housing is advantageously provided with locking spring arms that clip behind the plug-in connector housing when this is pushed into the plug-in opening with sufficient depth.

BRIEF DESCRIPTION OF THE DRAWINGS

The foregoing summary, as well as the following detailed description of a preferred embodiment of the invention, will be better understood when read in conjunction with the appended drawings. For purposes of illustrating the invention, there is shown in the drawings an embodiment which is presently preferred. It should be understood, however, that the invention is not limited to the precise arrangement and instrumentality shown. In the drawings.

DETAILED DESCRIPTION OF THE INVENTION

Figure 1:
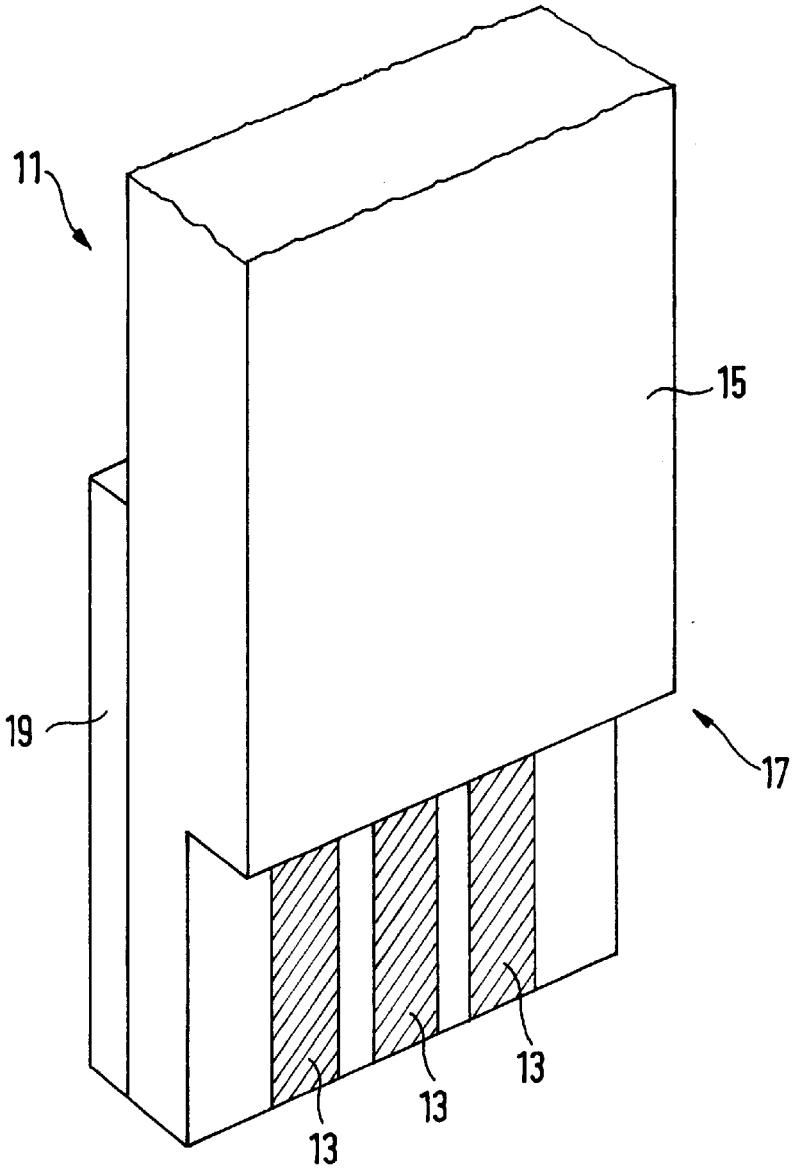
FIG.1 Prior Art
FIG. 1 illustrates a prior art ribbon cable end with flat conductors exposed on one side.

FIG. 1 illustrates a ribbon cable 11 in a schematic view with flat conductors 13 that are embedded on all sides in an insulation material 15. The insulation may be formed, for example, of sheets of insulation material that are applied on both sides of the flat conductors 13. The insulation material may be expanded polytetrafluoroethylene (ePTFE), polyester, or any other suitable insulation material. Enough insulation material is removed in one end region 17 of the ribbon cable 11 so that the flat conductors 13 are exposed on one side and are accessible for electrical contact. A reinforcement sheet 19 consisting of, for example, polyester, is applied to the insulation material 15 on a back portion of the ribbon cable 11. This serves to increase the bending rigidity of the ribbon cable end reduced by exposure of flat conductors 13. Also, this serves to bring the ribbon cable end 17 to the dimensions of the plug-in connector contacts. Without such a reinforcement sheet 19, the ribbon cable end 17, which has a width of 15 mm and a thickness of 0.4 mm, for example, would become unstable and could only be handled with difficulty.

Figure 2:
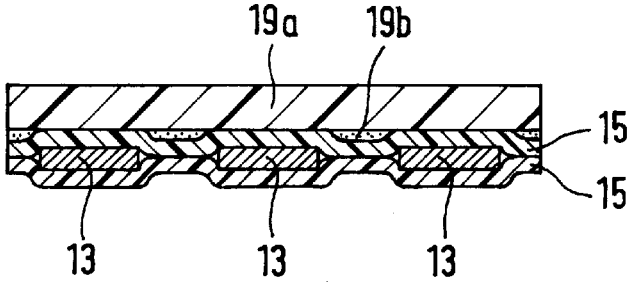
FIG. 2 illustrates a cross-sectional view of the ribbon cable of FIG. 1.

The cross-sectional view in FIG. 2 shows end region 17 in which the flat conductors 13 are exposed. The actual reinforcement sheet 19*a* is fastened to the insulation material by means of an adhesive layer 19*b*, for example, by means of a glue. The representation of three flat conductors 13 was chosen purely arbitrarily for the drawing.

Figure 3:
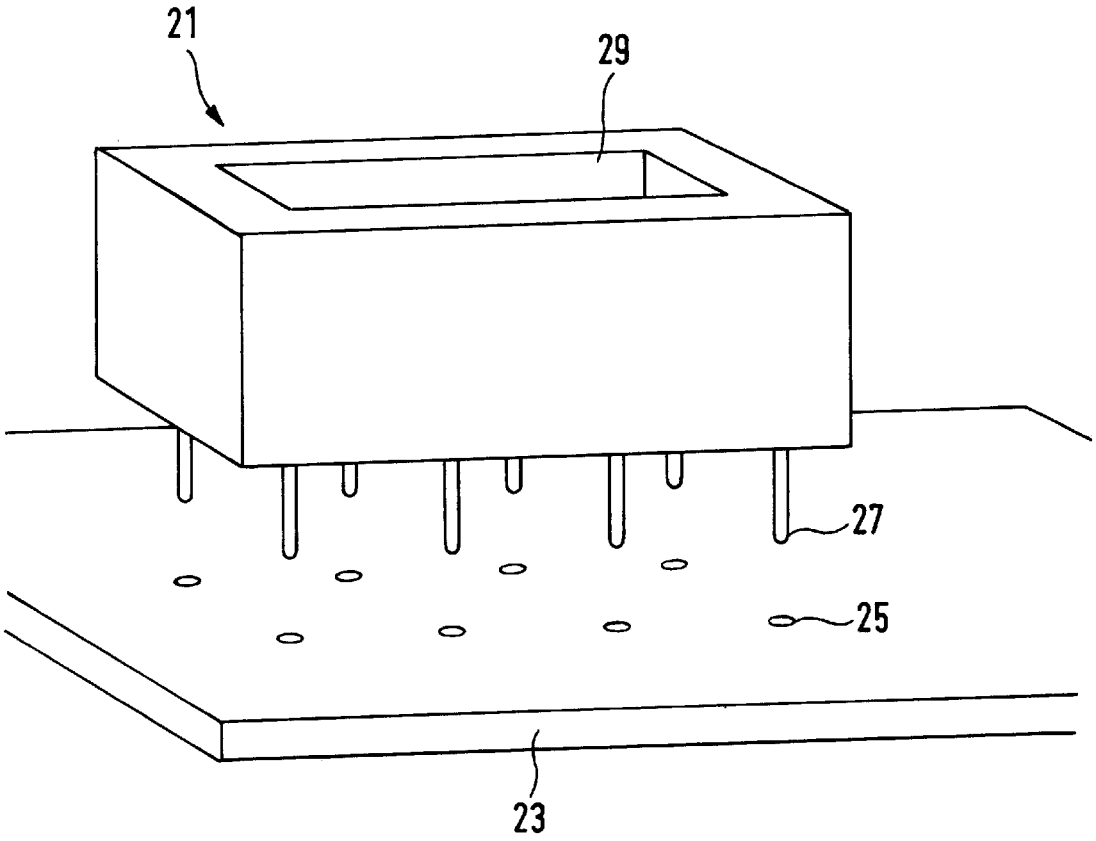
FIG. 3 Prior Art
FIG. 3 illustrates a conventional plug-in connector for a printed circuit board.

FIG. 3 shows a conventional plug-in connector 21 for accepting the ribbon cable 11 depicted in FIG. 1. A printed circuit board 23 has soldering holes 25 which receive connection posts 27 of the plug-in connector 21. The plug-in connector 21 is provided with a cable plug-in opening 29 on a side facing away from connection posts 27. Opening 29 has suitable dimensions so that ribbon cable 11 can be inserted into cable plug-in connector 21.

The plug-in connection between the ribbon cable 11, according to FIGS. 1 and 2, and the plug-in connector 21, according to FIG. 3, is known. Such known plug-in connectors 21 have a design height of about 10 mm and a typical insertion depth of the ribbon cable 11 of about 6 mm. The ribbon cable end 17 is, therefore, guided during insertion into the cable plug-in opening 29 only over a very short length so that there is a considerable hazard that the ribbon cable end 17 will be inserted obliquely into the cable plug-in opening 29, which can lead to incorrect contacting between the flat conductors 13 and the conductor contacts (not shown) which are arranged in the plug-in connector 21.

Figure 4:
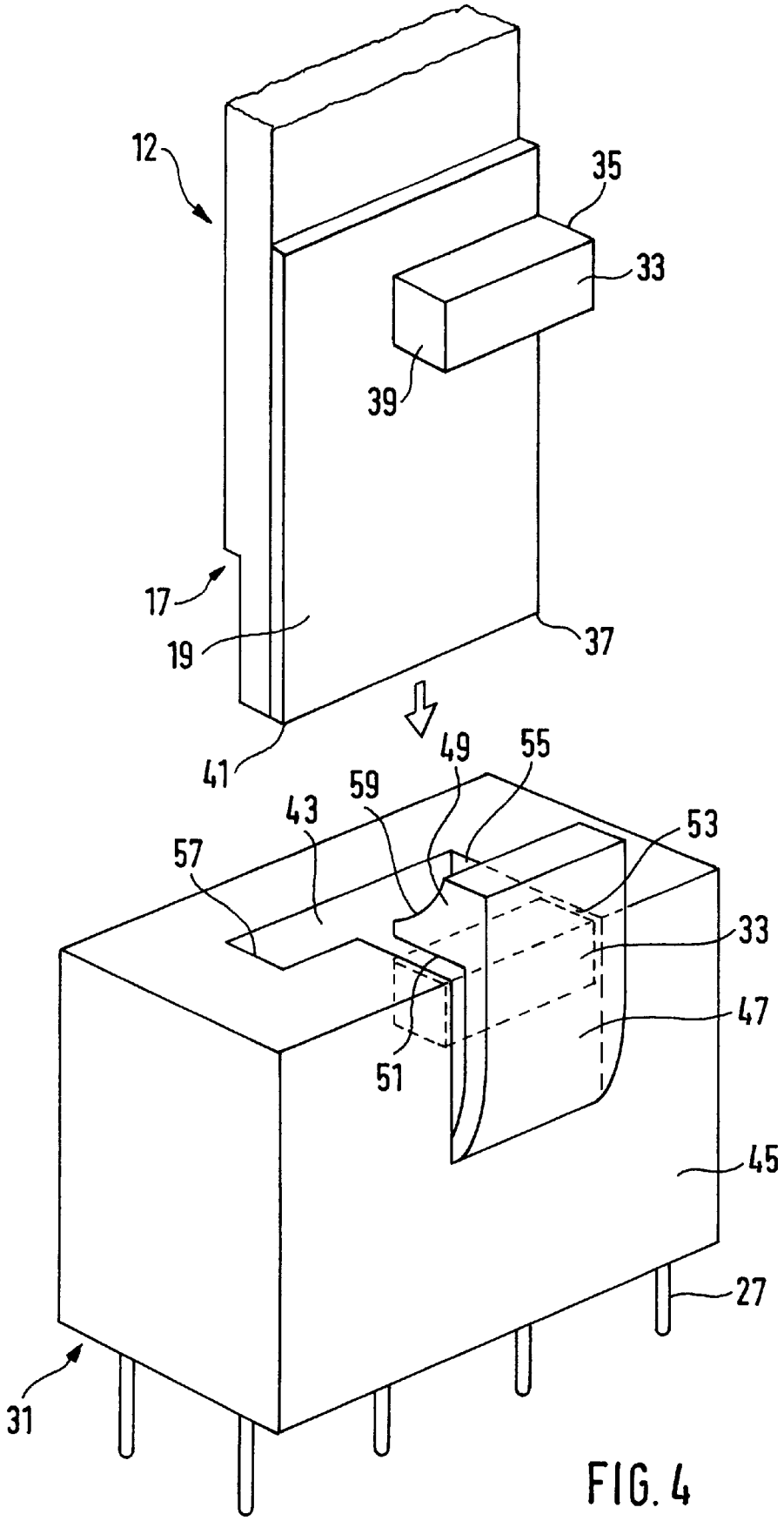
FIG. 4 illustrates one embodiment of a plug-in connector according to the present invention.

One embodiment of the present invention is shown in FIG. 4. In this embodiment, a ribbon cable plug-in connection is produced between a ribbon cable 12 and a plug-in connector 31. The ribbon cable 12 is designed as in FIG. 1, but it has a locking protrusion on the back side of the reinforcement sheet 19 in the form of a locking rib 33 that runs across the longitudinal direction of the ribbon cable 12. The locking rib 33 has a length that is less than the width of the ribbon cable 12. The locking rib 33 is asymmetrically arranged with respect to the longitudinal center line of the ribbon cable 12. A right rib end surface 35, in FIG. 4, is aligned with a right cable longitudinal side edge. A left rib end surface 39, in FIG. 4, is positioned opposite a left cable longitudinal side edge 41, and thus, defines a spacing relative to the edge 41.

The plug-in connector 31 has a centrally designed cable plug-in opening 43 which receives the ribbon cable 12. An elastic locking arm 47 is arranged in one piece on a front side 45, in FIG. 4. The locking arm 47 is provided on its free end with a locking hook 49, the bottom side of which forms a locking shoulder 51. A guide recess 53 is situated beneath locking shoulder 51 to guide locking rib 33 when the ribbon cable 12 is inserted into the cable plug-in opening 43. If the ribbon cable 12 is inserted far enough into cable plug-in opening 43 for contacting between flat conductors 13 and the conductor contacts of plug-in connector 31 (not shown), the locking rib 33 is situated beneath locking shoulder 51, as shown by the dashed line in FIG. 4.

The guide recess 53 is arranged displaced relative to the longitudinal center axis of the plug-in connector 31 corresponding to the displacement of the locking rib 33 relative to the longitudinal center line of ribbon cable 12. The guide recess 53 has lateral limitations that lie opposite the rib end surfaces 35 and 39 when the locking rib 33 is pushed into the guide recess 53.

As best seen by reference to FIG. 4, displacement of the guide recess 53 relative to the longitudinal center line of plug-in connector 31 is such that the right limitation of guide recess 53 is aligned with the right inside wall 55 of cable plug-in opening 43. The left limitation in the guide recess 53 defines a spacing from the left inside wall 57 of cable plug-in opening. This spacing corresponds roughly to the distance between the left longitudinal side edge of the ribbon cable 12 and the left rib end surface 39. Because of this displacement of guide recess 53 relative to the longitudinal center line of plug-in connector 31, a coding possibility is obtained for the plug-in connection. This means that ribbon cable end 12, with locking rib 33, can only be fully pushed into cable plug-in opening 43 if the locking rib 33 is situated on the correct side of cable plug-in opening 43. Coding can also be achieved by designing locking rib 33 with one or more recesses and/or interruptions distributed over its length. The guide recess 53 is then designed with a complementary countercoding form.

The design height of the plug-in connector 31 is significantly higher than the height of a conventional plug-in connector 21. This large design height permits a large insertion depth of the cable plug-in opening 43, thereby guiding the ribbon cable 12 over relatively large length during insertion into the cable plug-in opening 43. When the exposed flat conductors 13 of ribbon cable 12 enter the region of the contact springs of the conductor contacts, the ribbon cable 12 is aligned with high reliability so that no ineffective contacts occur.

The top of the locking hook 49 facing away from the locking shoulder is provided with a slope 59. The locking arm 47 is designed as an elastic spring arm that can be pivoted flexibly. When the bottom of the locking rib 33 comes in contact with slope 59, during insertion of ribbon cable 12 into the cable plug-in opening 43, the elastic locking arm 47 expands on further pressing down of locking rib 33 because of slope 59 and springs back as soon as the top of locking rib 33 comes to lie below locking shoulder 51. If a tensile force is then exerted on ribbon cable 12, which would lead to withdrawal of the ribbon cable from the cable plug-in opening 43, outward movement of the ribbon cable 12 is prevented. If the ribbon cable 12 is actually supposed to be withdrawn from the cable plug-in opening, the elastic locking arm need only be pivoted out of engagement with locking rib 33.

The locking rib 33 and the guide recess 53 may be dimensioned so that both the left and right lateral guide of the ribbon cable occurs only over the rib end surfaces 35 and 39. Another possibility is to achieve guiding only of one long side of ribbon cable 12 over one of the rib end surfaces 35 and 39, but to carry out guiding of the other long side of ribbon cable 12 by cooperation of this long side with the opposite inside walls 55 or 57 with the cable plug-in opening 43.

Figure 5:
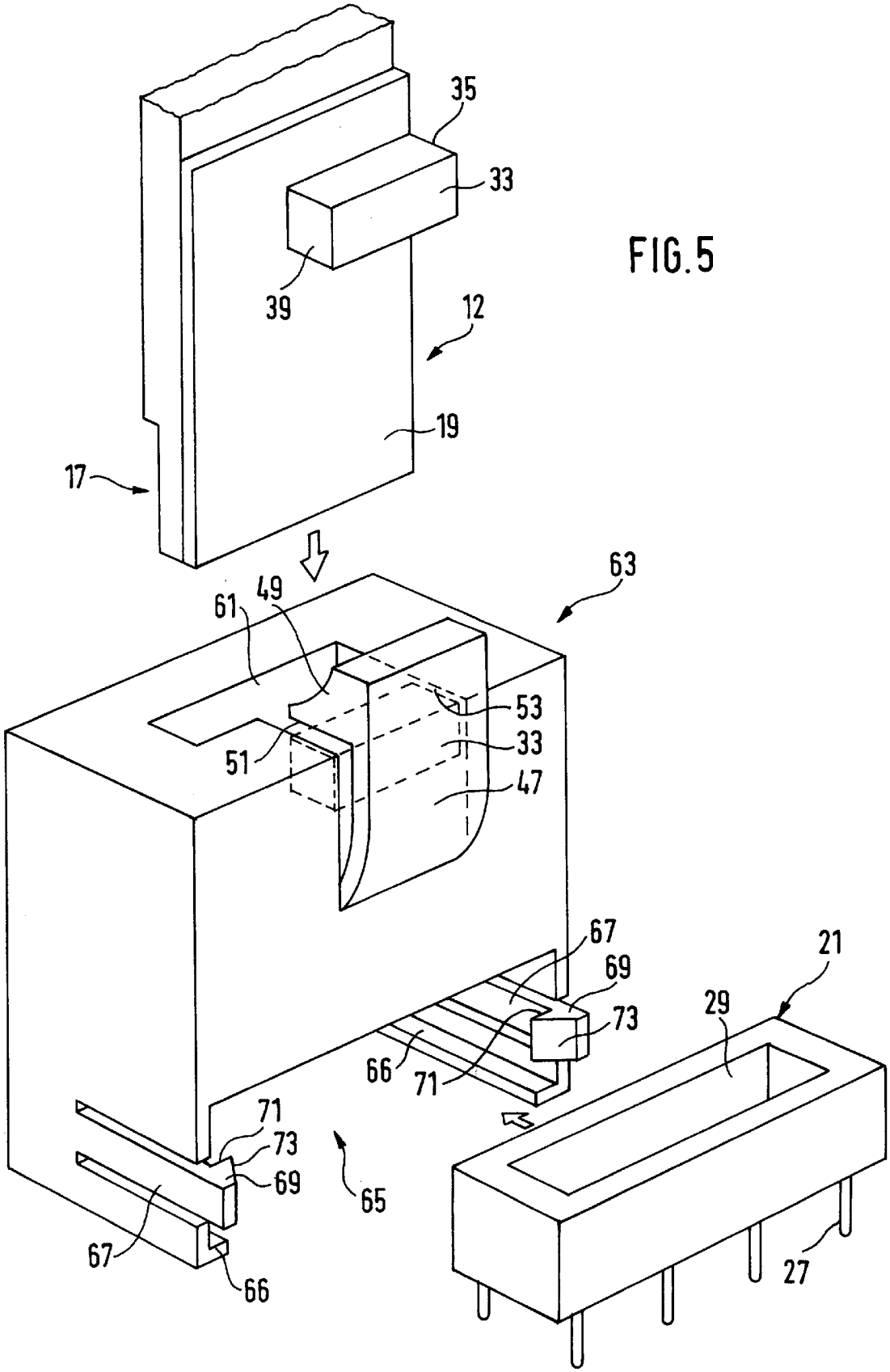
FIG. 5 illustrates another embodiment of the present invention having an additional connector housing.

FIG. 5 illustrates an alternate embodiment of the present invention in which the ribbon cable 12, provided with a locking rib 33, is indirectly inserted into the cable plug-in opening 29 of an ordinary plug-in connector 21, after being passed through a cable plug-through opening 61 of an additional housing 63. This embodiment of the present invention is advantageous if a conventional plug-in connector 21 is to be used, but the advantages of the present invention are to be achieved, namely good lateral guiding of ribbon cable 12 during insertion and its secure attachment in the inserted position.

The upper region of the additional housing 63 is designed similarly to the upper region of plug-in connector 31 of FIG. 4, namely with the locking arm 47, locking hook 49, locking shoulder 51, and with guide recess 53. The additional housing 63 has an insertion opening 65 on its lower end into which the plug-in connector 21 can be pushed. The insertion opening 65 is open on the bottom so as not to collide with the connection pins 27 of plug-in connector 21. Holding ribs 66 extend laterally from the side walls of the lower end of insertion opening 65 which prevent withdrawal of the additional housing 63 mounted on plug-in connector 21. The side walls of insertion opening 65 are each provided with a locking spring arm 67 cut from a corresponding side wall. Each locking spring arm 67 has on its free end a locking hook 69 with a locking shoulder 71 and a slope 73. During insertion of the plug-in connector 21 into the insertion opening 65, the locking spring arms 67 expand elastically when the plug-in connector 21 reaches the slope 73. If the plug-in connector 21 is pushed sufficiently deeply into insertion opening 65, the locking spring arms 67 spring back, during which their locking shoulders 71 engage behind plug-in connector 21, and thus fasten it within insertion opening 65.

The additional housing 63 may also be connected to plug-in connector 21, by any suitable method, such as for example, by gluing.

The plug-in opening 65 and the locking spring arms 67 are suitably dimensioned relative to the dimensions of the plug-in connector 21, so that when plug-in connector 21 is locked into plug-in opening 65, its cable plug-in opening 29 is aligned with the cable plug-through opening 61 of the additional housing 63. In this fashion, the ribbon cable 12 can be inserted through the cable plug-through opening 61, of the additional housing 63, into the cable plug-in opening 29 of plug-in connector 21 guided by the cable plug-through opening 61. The reliability with respect to correct alignment of the flat conductors 13 relative to the conductor contacts in the plug-in connector 21, and protection of the ribbon cable 12 against inadvertent withdrawal from the cable plug-in opening 29, is achieved by the additional housing 63 in cooperation with the locking rib 33. In this fashion the advantages achievable with the present invention are also implemented when a conventional plug-in connector 21 is used for the plug-in connection.

The additional housing 63 additionally offers the possibility of mating with plug-in connectors 21 that have already been soldered to a printed circuit board 23.

Since only the locking rib 33 is required to secure and guide the ribbon cable according to the present invention, a ribbon cable subsequently can be equipped for plug-in connection. For this purpose, one need only connect the locking rib 33 to a reinforcement sheet 19 in an appropriate position, for example, by gluing.

The additional housing 63 is described in further detail with reference to FIGS. 6 to 8.

Figure 6:
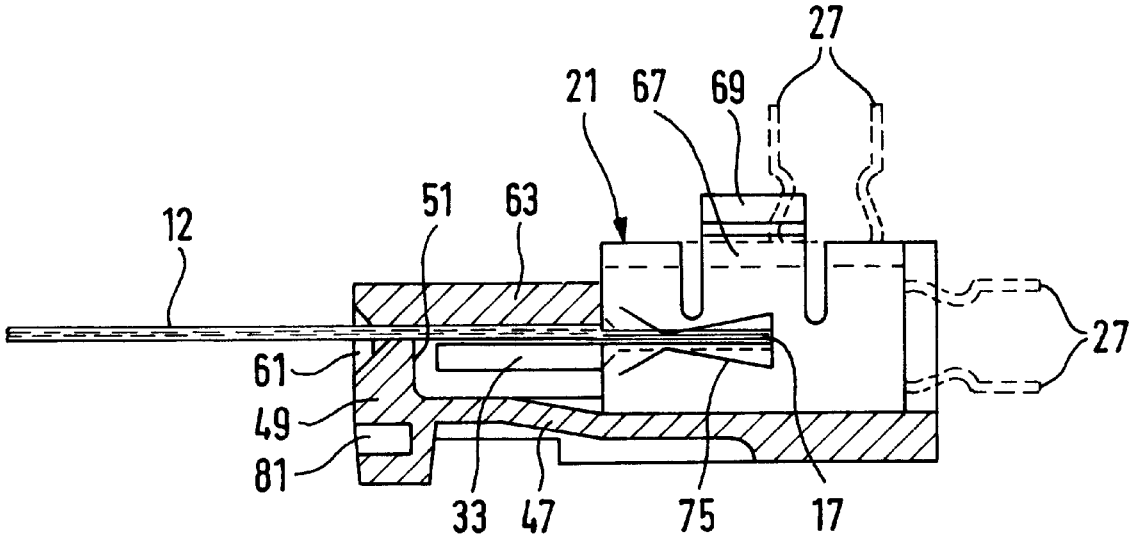
FIG. 6 illustrates a partial view of the additional housing depicted in FIG. 5 with the plug-in connector housing inserted and shown open.

FIG. 6 shows a plug-in connection between a ribbon cable 12 and a conductor contact 75 using an additional housing 63. Connection pins 27 can extend vertically or horizontally (seen in FIG. 6) and are electrically connected to corresponding conductor contacts 75 in a manner not shown in FIG. 6.

The locking arm 47 is illustrated with the locking hook 49 on its free end. The locking arm 47 has a smaller wall thickness than the side wall of the additional housing 63 from which the locking arm 47 extends in order to impart soft spring characteristics to the locking arm 47.

As can be seen with reference to FIG. 6, the end region 17 defines exposed flat conductors 13 which are placed between the spring arms of conductor contacts 75. The locking rib 33 is engaged by the locking shoulder 51 of locking hook 49. The housing of the plug-in connector 21 (shown with a dashed line) is engaged by the locking hook 69, and thus, secured in its position within insertion opening 65.

Figure 7:
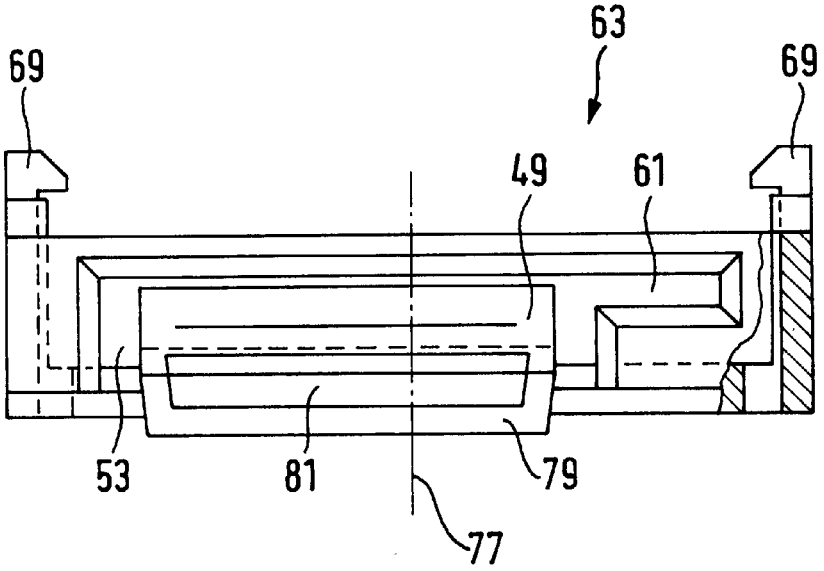
FIG. 7 illustrates an upper front view of the additional housing of FIG. 5.

FIG. 7 shows a top view of the additional housing 63, seen from the left in FIG. 6. FIG. 7 reveals the unsymmetric or displaced position (relative to centerline 77) of the guide recess 53. Locking hook 49 has a clamp 79 on a lower side that forms an engagement opening 81. A loosening tool or even a fingernail can be inserted into this opening 81 when the locking hook 49, and the locking rib 33, are to be released in order to be able to withdraw ribbon cable 12 from the plug-in connector 21. The engagement opening 81 need not go all the way through, but merely be an engagement cavity that permits engagement of the loosening tool or fingernail, as shown in FIG. 6.

Figure 8:
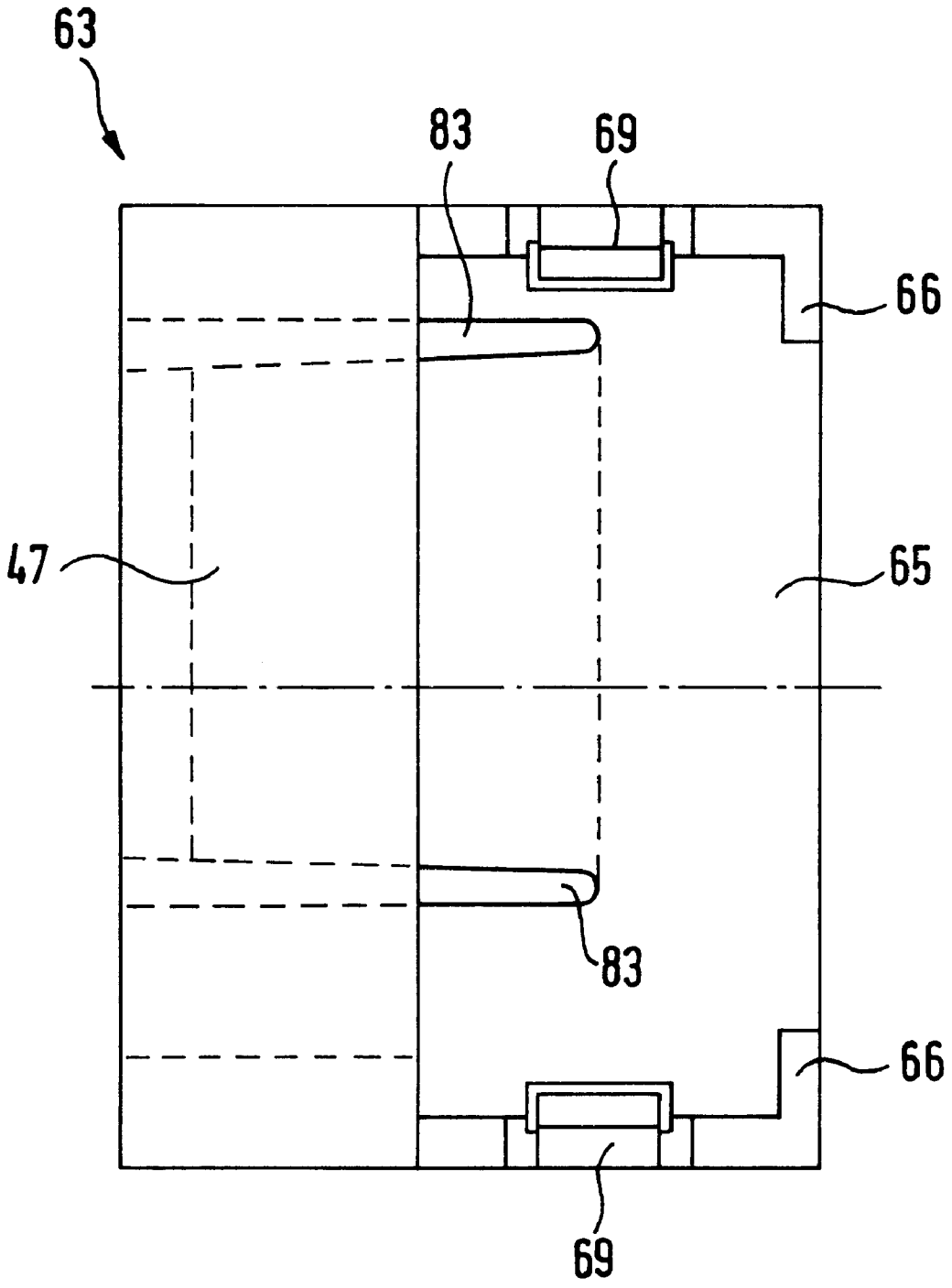
FIG. 8 illustrates a longitudinal side view of the additional housing of FIG. 5.

FIG. 8 shows a view of the insertion opening side of the additional housing 63 seen from above in the lying position in FIGS. 6 and 7. In the embodiment shown in FIG. 8, the locking arm 47 is cut via slits 83 from the corresponding side wall of the additional housing 63.

Although a few exemplary embodiments of the present invention have been described in detail above, those skilled in the art readily appreciate that many modifications are possible without materially departing from the novel teachings and advantages which are described herein. Accordingly, all such modifications are intended to be included within the scope of the present invention, as defined by the following claims.

What is claimed is:

1. A ribbon cable plug-in connector for plug-in connection of an electrical ribbon cable, wherein said ribbon cable has a width, a wide side, an end, a first and second longitudinal side, a longitudinal middle line and at least one ribbon cable conductor having a ribbon cable conductor first side, a ribbon cable conductor second side and a ribbon cable conductor end, wherein an insulation material is disposed about said at least one ribbon cable conductor, wherein a locking projection having a width and a center extends over part of said width of said ribbon cable, the locking projection width being smaller than the width of the ribbon cable, and wherein said ribbon cable conductor first side being exposed at said ribbon cable conductor end, said ribbon cable plug-in connector comprising:

a plug-in connector housing, said plug-in connector housing defining a cable plug-in opening having a center and adapted to allow insertion of said end of said ribbon cable, and said plug-in connector housing having a center, a transverse internal wall and a longitudinal side wall;

a locking arm arranged on said plug-in connector housing that cooperates elastically with said locking projection on said ribbon cable; and a locking shoulder disposed on said locking arm, said locking shoulder being adapted to overlap said locking projection when said ribbon cable is inserted into said cable plug-in opening, whereby after insertion said center of said locking projection and said center of cable plug-in opening are displaced relative to said longitudinal middle line of said ribbon cable to facilitate selective insertion of said ribbon cable into said plug-in opening.

2. The invention of claim 1, wherein said locking projection has a front surface and a profile, wherein said plug-in connector housing defines a locking projection guide formed in said plug-in opening, and wherein said locking projection guide positionally guides said front surface of said locking projection when said ribbon cable is inserted in said plug-in opening.

3. The invention of claim 2, wherein said locking projection guide has a guiding recess formed in a longitudinal side wall of said plug-in connector housing, wherein said guiding recess is adapted to said profile of said locking projection, and wherein said locking projection is guided into said guiding recess when said ribbon cable is inserted into said plug-in opening.

4. The invention of claim 2, wherein said transverse internal wall of said plug-in connector housing guides a first longitudinal side of said ribbon cable at said end, and wherein said front surface of said locking projection guides said second longitudinal side.

5. The invention of claim 1, wherein said ribbon cable further comprises a strengthening layer disposed on said wide side near said end of said ribbon cable.

6. The invention of claim 1, wherein said locking projection is assembled in the form of a locking rib extending transversely relative to the longitudinal direction of said ribbon cable.

7. The invention of claim 6, wherein the locking rib has a rectangular cross section.

8. The invention of claim 5, wherein said locking projection is a separate element fixed to said strengthening layer.

9. The invention of claim 5, wherein said locking projection is singularly formed with said strengthening layer.

10. The invention of claim 1, wherein said locking arm is constructed integrally in the form of one single component with said plug-in connector housing.

11. The invention of claim 1, wherein said plug-in connector housing is an additional housing disposable about a second plug-in connector having a second plug-in opening.

12. The invention of claim 11, wherein said second plug-in opening of said second plug-in connector is adapted to be aligned with said plug-in opening of said plug-in connector housing.

13. The invention of claim 12, wherein said plug-in connector housing further comprises at least one engagement arm having a free end and an engagement shoulder at said free end adapted to capture said second plug-in connector.

14. The invention of claim 11, wherein said locking projection guide is formed in said additional housing.

15. The invention of claim 1, wherein said locking arm is cut from a side wall of said plug-in connector housing.

16. The invention of claim 15, wherein said locking arm has a smaller wall thickness than the side wall with which it is single componently integrally constructed.

17. An electrical ribbon cable having a width, a wide side, an end, a first and second longitudinal side, a longitudinal middle line, said electrical ribbon cable being adapted for plug-in connection to a ribbon cable plug-in connector, the ribbon cable plug-in connector having a plug-in connector housing defining a cable plug-in opening having a center and adapted to allow insertion of said end of said ribbon cable, whereby said plug-in connector housing has a center, a transverse internal wall and a longitudinal side wall and a locking arm arranged on said plug-in connector housing, the ribbon cable comprising:

at least one ribbon cable conductor having a ribbon cable conductor first side, a ribbon cable conductor second side and a ribbon cable conductor end, an insulation material disposed about said at least one ribbon cable conductor except at said ribbon cable end where said ribbon cable conductor first side is exposed, and a locking projection with a width and a center extending over part of said width of said ribbon cable, the locking projection width being smaller than the width of the ribbon cable and cooperating elastically with the locking arm arranged on said plug-in connector housing for locking after insertion said ribbon cable in said plug-in connector housing, whereby after insertion said center of said locking projection and said center of said cable plug-in opening are displaced relative to said longitudinal middle line of said ribbon cable to facilitate selective insertion of said ribbon cable into said plug-in opening.

18. The invention of claim 17, wherein said plug-in connector further comprises a locking shoulder disposed on said locking arm, said locking shoulder being adapted to overlap the locking projection when said ribbon cable is inserted into said cable plug-in opening.

19. The invention of claim 17 wherein said ribbon cable further comprises a strengthening layer disposed on said wide side near said end of said ribbon cable.

20. The invention of claim 17, wherein said locking projection is assembled in the form of a locking rib extending transversely relative to the longitudinal direction of said ribbon cable.

21. The invention of claim 20, wherein the locking rib has a rectangular cross section.

22. The invention of claim 17, wherein said locking projection is a separate element fixed to said strengthening layer.

23. The invention of claim 17, wherein said locking projection is singularly formed with said strengthening layer.

* * * * *